US008397979B2

(12) United States Patent
Bates

(10) Patent No.: US 8,397,979 B2
(45) Date of Patent: Mar. 19, 2013

(54) CARTON WITH TEAR INITIATION FEATURE

(75) Inventor: Aaron L. Bates, Moseley, VA (US)

(73) Assignee: MeadWestvaco Packaging Systems, LLC, Richmond, VA (US)

( * ) Notice: Subject to any disclaimer, the term of this patent is extended or adjusted under 35 U.S.C. 154(b) by 0 days.

(21) Appl. No.: 13/473,727

(22) Filed: May 17, 2012

(65) Prior Publication Data

US 2012/0292379 A1 Nov. 22, 2012

Related U.S. Application Data

(60) Provisional application No. 61/487,125, filed on May 17, 2011.

(51) Int. Cl.
*B65D 5/468* (2006.01)

(52) U.S. Cl. ..... 229/117.16; 229/117.13; 229/208

(58) Field of Classification Search ..... 229/117.13, 229/117.14, 117.16, 117.17, 207, 208; 206/141, 206/427
See application file for complete search history.

(56) References Cited

U.S. PATENT DOCUMENTS 3,410,476 A * 11/1968 Buttery ..... 229/208
4,109,849 A * 8/1978 Wood ..... 229/117.14
4,498,619 A * 2/1985 Roccaforte ..... 229/117.13
4,531,668 A * 7/1985 Forbes, Jr. ..... 229/207
4,588,084 A * 5/1986 Holley, Jr. ..... 206/427
5,307,987 A * 5/1994 Roccaforte ..... 229/117.13
5,350,062 A * 9/1994 Takiguchi et al. ..... 229/207
5,350,109 A * 9/1994 Brown et al. ..... 229/117.16
6,085,969 A * 7/2000 Burgoyne ..... 229/117.17
6,260,755 B1 * 7/2001 Bates et al. ..... 229/117.13
7,699,215 B2 * 4/2010 Spivey, Sr. ..... 229/117.16
7,832,621 B2 * 11/2010 Smalley ..... 206/427

* cited by examiner

*Primary Examiner* — Gary Elkins
(74) *Attorney, Agent, or Firm* — MWV Intellectual Property Group

(57) ABSTRACT

A carton has a wall including overlapping portions of an outside panel and an inside panel. The outside panel includes an outside handle flap defined by an outside severance line while the inside panel includes an inside handle flap defined by an inside severance line. At least a portion of the outside severance line is in substantial registry with at least a portion of the inside severance line where the outside panel overlaps the inside panel. The inside handle flap includes a relief severance line extending from the inside severance line such that the relief severance line divides the inside handle flap into a delamination section and the other section. The relief severance line is configured to initiate delamination of at least the delamination section of the inside handle flap. The structure is at least partially detachable from the carton along the outside and inside severance lines.

20 Claims, 5 Drawing Sheets

CARTON WITH TEAR INITIATION FEATURE

CROSS REFERENCE TO RELATED APPLICATION

This application claims priority to U.S. Provisional Application No. 61/487,125, filed May 17, 2011, the entirety of which is incorporated herein by reference.

FIELD OF THE INVENTION

This invention relates generally to cartons, and more particularly, to cartons with a tear initiation feature.

BACKGROUND OF THE INVENTION

Cartons that encase multiple articles such as bottles are useful to transport and store articles. Many cartons include handles or other structures that are generally removed by tear initiation along a severance line and then further tearing along the severance line. Where such structures are part of walls that are formed from overlapping panels, there is a risk that glue that is used to secure the overlapping panels to one another may make the tear initiation feature inoperable. For example, the glue may spread into a severance line along which a structure is normally detachable and prevent a user from initiating a tear along the severance line. As such, the structure cannot be properly removed by tearing along the severance line.

SUMMARY OF THE INVENTION

The present invention overcomes the shortcomings of the prior art by providing a carton with a tear initiation feature that initiates a tear along aligned severance lines. The tear initiation feature includes a relief severance line that is configured to initiate delamination of a panel that is overlapped by another panel.

According to an exemplary embodiment, a carton includes a wall. The wall includes a first panel that overlaps a second panel. The first panel includes a first handle flap defined by a first severance line and the second panel includes a second handle flap defined by a second severance line. The first severance line is aligned with the second severance line where the first panel overlaps the second panel. The second handle flap includes a relief severance line that is configured to initiate delamination of at least a delamination section of the second handle flap.

The foregoing has broadly outlined some of the aspects and features of the present invention, which should be construed to be merely illustrative of various potential applications of the invention. Other beneficial results can be obtained by applying the disclosed information in a different manner or by modifying the disclosed embodiments. Accordingly, other aspects and a more comprehensive understanding of the invention may be obtained by referring to the detailed description of the exemplary embodiments taken in conjunction with the accompanying drawings, in addition to the scope of the invention defined by the claims.

DETAILED DESCRIPTION

Figure 1:
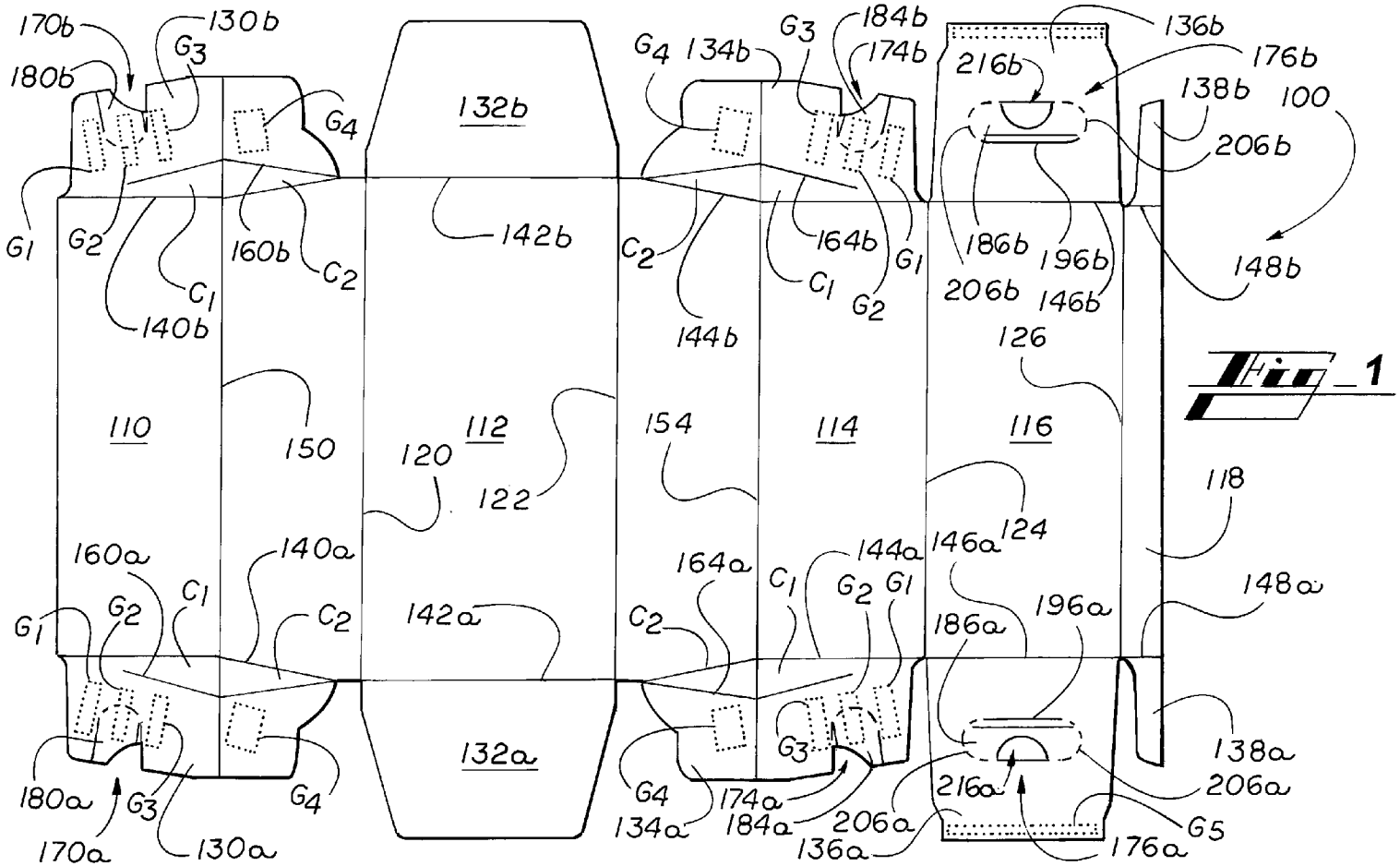
FIG. 1 is a plan view of a carton blank in accordance with an exemplary embodiment of the present invention.

As required, detailed embodiments of the present invention are disclosed herein. It must be understood that the disclosed embodiments are merely exemplary of the invention that may be embodied in various and alternative forms, and combinations thereof. As used herein, the word "exemplary" is used expansively to refer to embodiments that serve as illustrations, specimens, models, or patterns. The figures are not necessarily to scale and some features may be exaggerated or minimized to show details of particular components. In other instances, well-known components, systems, materials, or methods have not been described in detail in order to avoid obscuring the present invention. Therefore, specific structural and functional details disclosed herein are not to be interpreted as limiting, but merely as a basis for the claims and as a representative basis for teaching one skilled in the art to variously employ the present invention.

Referring now to the drawings, wherein like numerals indicate like elements throughout the several views, the drawings illustrate certain of the various aspects of exemplary embodiments of a carton. In the embodiments detailed herein, the term carton refers, for the non-limiting purpose of illustrating the various features of the invention, to a container for enclosing, carrying, and dispensing articles, such as beverage cans. However, it is contemplated that the teachings of the invention can be applied to various containers. Generally described, exemplary end-loaded cartons include a tubular structure that is defined by a top wall, first and second side walls, and a bottom wall and includes end closure structures that define end walls at each of the open ends of the tubular structure.

Referring to the exemplary embodiment illustrated in FIGS. 1-8, a carton 300 is formed from a blank 100. The inside surface of the blank 100 is shown in FIG. 1 and the opposite side (not shown) of the blank 100 is its outside surface. The outside surface may be used as its art side for printing product information, decorative designs, and brand specific indicia, such as logos, trademarks and associated copy. Either or both the inside and outside surface may be laminated or otherwise treated to make the carton water-resistant, more durable, or to insulate the contents of the carton.

The blank 100 includes a sheet of suitable substrate made of layers that can delaminate from one another. It is to be understood that, as used herein, the term "suitable substrate" includes all manner of foldable sheet material such as paperboard, corrugated board, cardboard, plastic, combinations thereof, and the like. In the illustrated embodiments, the unitary blank 100 is used to form a single carton. However, it should be recognized that two or more blanks may be employed, for example, to provide the carton structure described in more detail below.

In the exemplary embodiment, the blank 100 is configured to form a carton for packaging an exemplary arrangement of exemplary articles. For example, the arrangement is a 3×4 matrix arrangement and the articles are glass bottles. The blank can be alternatively configured to form a carton for packaging other articles and/or different arrangements of articles.

As used herein, the term "fold line" refers to all manner of lines that define hinge features of the blank, facilitate folding portions of the blank with respect to one another, or otherwise indicate optimal panel folding locations for the blank. A fold line is typically a scored line, an embossed line, or a debossed line.

As used herein, the term "severance line" refers to all manner of lines that facilitate separating portions of the substrate from one another or that indicate optimal separation locations. Severance lines may be frangible or otherwise weakened lines, tear lines, cut lines, or slits. For purposes of teaching, a half-cut line is a severance line that has a cut depth that is less than the thickness of the substrate. For example, the cut depth is approximately half of the depth of the thickness of the substrate.

It should be understood that severance lines and fold lines can each include elements that are formed in the substrate of the blank including perforations, a line of perforations, a line of short slits, a line of half-cuts, a single half-cut, a cut line, an interrupted cut line, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

Referring to FIG. 1, the blank 100 includes a series of primary panels that define the walls of a tubular structure of the carton 300. The primary panels are aligned along a longitudinal axis of the blank 100 and are hingedly connected one to the next along fold lines that extend transversely with respect to the longitudinal axis. Specifically, the primary panels include a first side panel 110, a bottom panel 112, a second side panel 114, and a top panel 116. The first side panel 110 is hingedly connected to the bottom panel 112 along fold line 120, the bottom panel 112 is hingedly connected to the second side panel 114 along fold line 122, and the second side panel 114 is hingedly connected to the top panel 116 along fold line 124. The blank 100 further includes an edge panel 118 that facilitates securing the endmost primary panels to one another. In the exemplary embodiment, the edge panel 118 is hingedly connected to the top panel 116 along a fold line 126. In alternative embodiments, the edge panel 118 is connected to the first side panel 112 instead. Further, the primary panels can be alternatively sequenced, for instance, such that the top panel 116 is first, followed by the first side panel 110, the bottom panel 112, and then the second side panel 114.

End flaps are hingedly connected to opposite ends of each primary panel along fold lines that extend generally parallel to the longitudinal axis. The end flaps can be folded and secured to form end closure structures at respective open ends of the tubular structure of the carton 300 and thereby define the end walls of the carton 300. The blank 100 is substantially symmetric such that the end flaps that are hingedly connected to the opposite ends of each primary panel are substantially similar. Accordingly, the end closure structures of the carton 300 are substantially identical and like references have been used with a suffix "a" or "b" to distinguish one end of the carton 300 from the other. The description of an element or group of elements having a suffix "a" is suitable for a like-numbered element or group of elements having a suffix "b". In certain instances, for clarity, only one of the like elements may be described unless a description of the other or both of the like elements is useful for understanding the invention.

First side end flap 130*a* is hingedly connected to first side panel 110 along fold line 140*a*, bottom end flap 132*a* is hingedly connected to bottom panel 112 along fold line 142*a*, second side end flap 134*a* is hingedly connected to second side panel 114 along fold line 144*a*, top end flap 136*a* is hingedly connected to top panel 116 along fold line 146*a*, and edge end flap 138*a* is hingedly connected to edge panel 118 along fold line 148*a*.

Blank 100 includes fold lines that allow the carton 300 to conform to the shape of a group of articles and also facilitate folding the blank 100 as a collapsed tubular structure. A fold line 150 extends transversely across each of first side panel 110 and first side end flaps 130*a*, 130*b*. Similarly, a fold line 154 extends transversely across each of second side panel 114 and second side end flaps 134*a*, 134*b*. Fold lines 150, 154 allow the top end of the carton 300 to be tapered to conform to the shape of a group of tapered articles.

Each side end flap 130*a*, 134*a* includes a fold line 160*a*, 164*a*. The fold lines define corner panels C1, C2 in each side end flap 130*a*, 134*a*. For purposes of clarity, one pair of corner panels C1, C2 (those of first side end flap 130*a*) is described in further detail. The fold line 140*a* and the fold lines 160*a* are curved and, along with a segment of fold line 150, define the corner panels C1, C2. Fold lines 140*a*, 160*a* intersect or are near one another at their ends and move away from each other as they near the fold line 150 such that the corner panels C1, C2 are triangular. The corner panels C1, C2 are configured to wrap around the articles at a corner of the carton 300.

Figure 2:
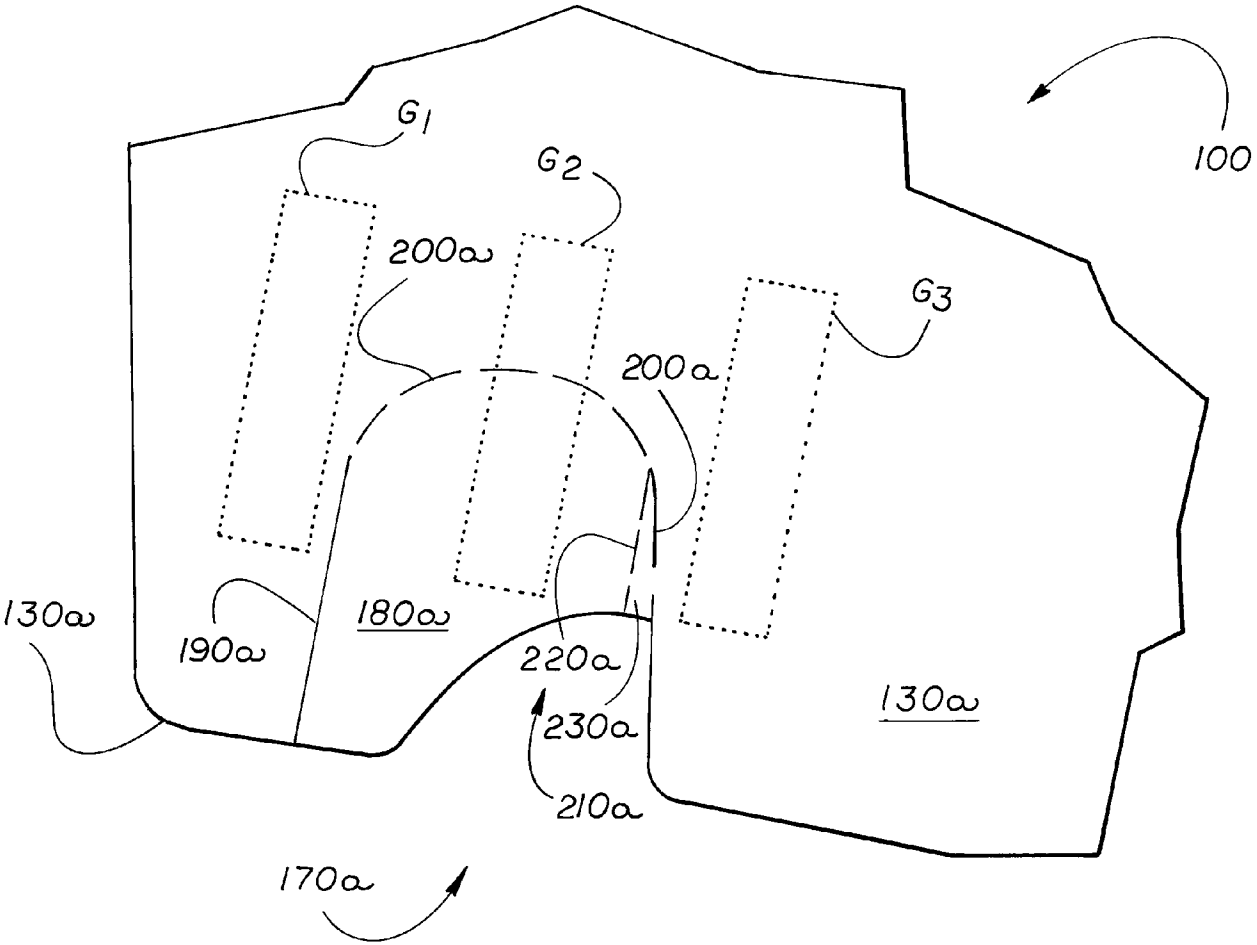
FIG. 2 is a partial plan view of the carton blank of FIG. 1, illustrating a first side end flap of the carton blank.
Figures 5, 6:
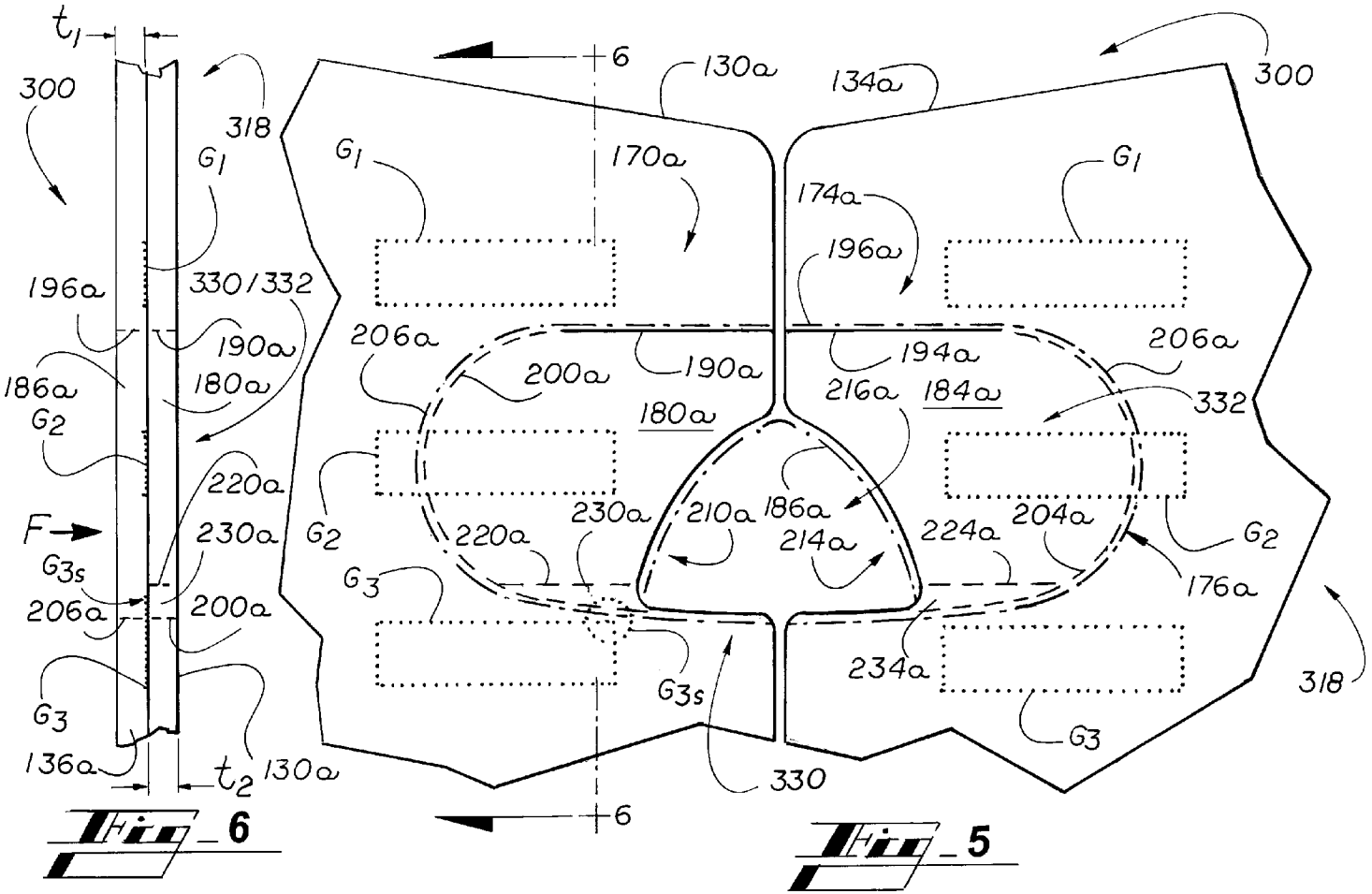
FIG. 5 is a partial plan view of an end wall of the carton of FIG. 4.
FIG. 6 is a partial cross-sectional view of the end wall of FIG. 5.

Referring to FIGS. 1, 2, and 5, the blank 100 further includes elements that form a handle 330 and handle flap 332 that are configured to allow a user to carry the carton 300. Certain of the features of the side end flaps 130*a*, 134*a* are not labeled in FIG. 1 to avoid cluttering the figure and feature of side end flap 134*a* are substantially similar to those of FIG. 130*a* shown in FIG. 2. The first side end flap 130*a* includes a first handle slot 170*a*, the second side end flap 134*a* includes a second handle slot 174*a*, and the top end flap 136*a* includes a main handle opening 176*a*. Referring to FIG. 5, the handle slots 170*a*, 174*a* are configured to align with, and thereby reinforce, the edge of the main handle opening 176*a*. Continuing with FIGS. 1 and 5, each of the handle slots 170*a*, 174*a* is initially filled by a minor handle flap 180*a*, 184*a* that is partially removable. The main handle opening 176*a* is initially filled by a main handle flap 186*a* that is partially removable. In FIG. 5, elements of top end flap 136*a* are shown with hidden lines to indicate the relationship to the elements of the side end flaps 130*a*, 134*a*. Here, elements that align may be shown as slightly offset from one another so as not to obstruct one another.

Referring to FIG. 5, the minor handle flaps 180*a*, 184*a* are hingedly connected to the edge of the handle slots 170*a*, 174*a* along fold lines 190*a*, 194*a* and, referring to FIG. 1, the main handle flap 186*a* is hingedly connected to the edge of the main handle opening 176*a* along a fold line 196*a*. Referring to FIG. 5, the minor handle flaps 180*a*, 184*a* are separable from the edge of the handle slots 170*a*, 174*a* along severance lines 200*a*, 204*a* and, referring to FIG. 1, the main handle flap 186*a* is separable from the edge of the main handle opening 176*a* along a severance line 206*a*. Referring to FIGS. 1 and 5, each of the minor handle flaps 180*a*, 184*a* includes a notch 210*a*, 214*a* that is configured to align with a notch 216*a* in the main handle flap 186*a*.

Referring to FIGS. 2 and 5, the minor handle flaps 180*a*, 184*a* include a relief severance line 220*a*, 224*a* that extends from the severance line 200*a*, 204*a* to the free edge of the minor handle flap 180*a*, 184*a*. Although each illustrated relief severance line 220*a*, 224*a* is a half-cut severance line that has a cut depth that is less than the thickness of the blank 100, other types of severance lines are contemplated to provide the functionality described herein. Referring momentarily to FIG. 6, the relief severance line 220*a* is cut in the outside surface of the minor handle flap 180*a* and has a depth that extends approximately half-way through the thickness of the minor handle flap 180*a*. Continuing with FIGS. 2 and 5, the relief severance lines 220*a*, 224*a* and a segment of the severance line 200*a*, 204*a* define delamination sections 230*a*, 234*a* that are configured to delaminate to facilitate tear initiation as described in further detail below.

For purposes of teaching, certain glue locations are illustrated. Glue locations G1, G2, G3 are selected to secure the upper portions of the side end flaps 130*a*, 134*a* to the top end flap 136*a*. Glue locations G4 are selected to secure the lower portions of the side end flaps 130*a*, 134*a* to the bottom end flap 132*a* and glue locations G5 are selected to secure the bottom end flap 132*a* to the top end flap 136*a*. Although glue locations G and relief severance lines 220, 224 are associated with the outside surface of the blank 100, these elements are shown in FIGS. 1 and 2 for purposes of illustration.

Figures 7, 8:
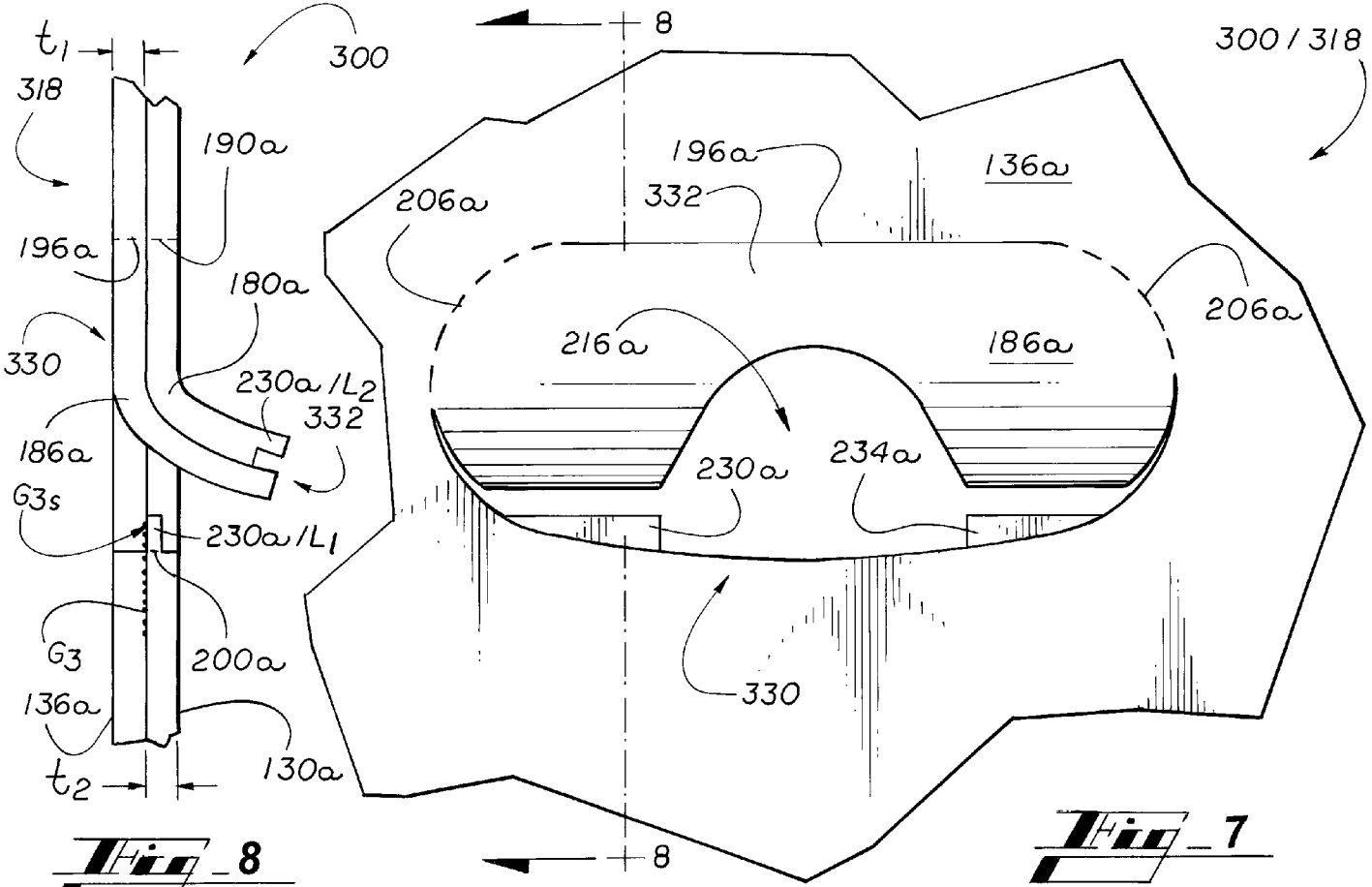
FIG. 7 is a partial plan view of the end wall of FIG. 5, illustrating operation of a tear initiation feature.
FIG. 8 is a partial cross-sectional view of the end wall of FIG. 7, illustrating operation of the tear initiation feature.

Securing the upper portions of the side end flaps 130*a*, 134*a* to the top end flap 136*a* includes securing the minor handle flaps 180*a*, 184*a* to the main handle flap 186*a* at glue location G2. Glue, such as hot-melt glue, that is applied at the glue locations G3 has the potential to spread into the severance lines 200*a*, 204*a* and solidify to make initiating a tear along the severance line 200*a*, 204*a* difficult, as described in further detail below. For purposes of teaching, a glue spreading area G3*s* that overlaps severance line 200*a* is illustrated in FIGS. 5, 6 and 8. To address the possibility of glue spreading into the severance lines 200*a*, 204*a* at glue spreading areas G3*s*, the relief severance line 220*a*, 224*a* provides a tear initiation feature that includes the delamination sections 230*a*, 234*a* defined by the relief severance lines 220*a*, 224*a*.

It should be noted that, although glue that is applied at locations G2 is applied over the severance lines 200*a*, 204*a*, glue at glue locations G2 rarely presents a problem since the hand-closing force that is applied to handle flap 332 once the tear is initiated is greater than the finger-pressing force that is applied to initiate the tear.

Erecting the carton 300 from the blank 100 may be accomplished with the folding and gluing operations as described herein. The operations can be performed by automatic erecting machinery and/or manually. The method of performing the erecting process is not limited to the exemplary method described herein. Particularly, the order of the steps can be altered according to manufacturing requirements, steps may be added or omitted, and the means for securing components to one another may vary. Generally, surfaces of sheet material may be secured together by glue or other adhesives. However, other suitable means for securing include tape, staples, interlocking folds, VELCRO®, combinations thereof, and the like.

Referring to FIG. 1, the blank 100 can be folded and secured to form a collapsed tubular structure by folding the blank 100 inwardly along fold line 154 into flat face contact with itself, applying glue or other adhesive to the outside surface of the edge flap 118 and to the outside surface of each of the edge end flaps 138*a*, 138*b*, and folding the blank 100 along the fold line 150 such that the inside surface of the first side panel 110 is in flat face contact with, and thereby secured to, the outside surface of the edge flap 118. Also, the inside surfaces of the first side end flaps 130*a*, 130*b* are in flat face contact with, and thereby secured to, the outside surface of the edge end flaps 138*a*, 138*b*. As such, the blank 100 is folded and secured as a collapsed tubular structure.

Figure 3:
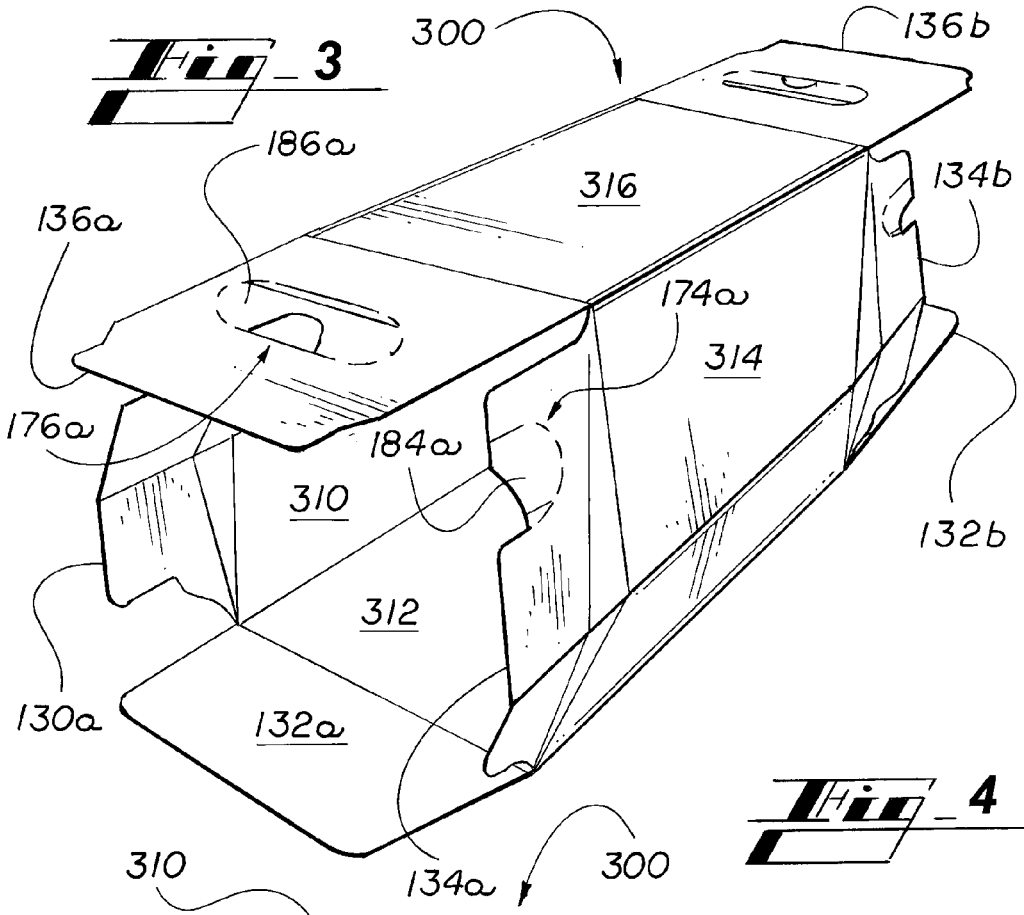
FIGS. 3 and 4 are perspective views of a carton formed from the blank of FIG. 1.

The tubular structure can thereafter be erected from the collapsed tubular structure (shown in FIG. 3) such that the primary panels form the walls of the tubular structure. Referring to FIGS. 1 and 3, the first side panel 110 forms a first side wall 310, the bottom panel 112 forms a bottom wall 312, the second side panel 114 forms a second side wall 314, and the top panel 116 forms the top wall 316. The tubular structure of the carton includes open ends through which articles can be loaded. It should be understood that the end flaps can be folded outwardly or otherwise so as not to obstruct articles as they are loaded through one or both of the open ends.

Figure 4:
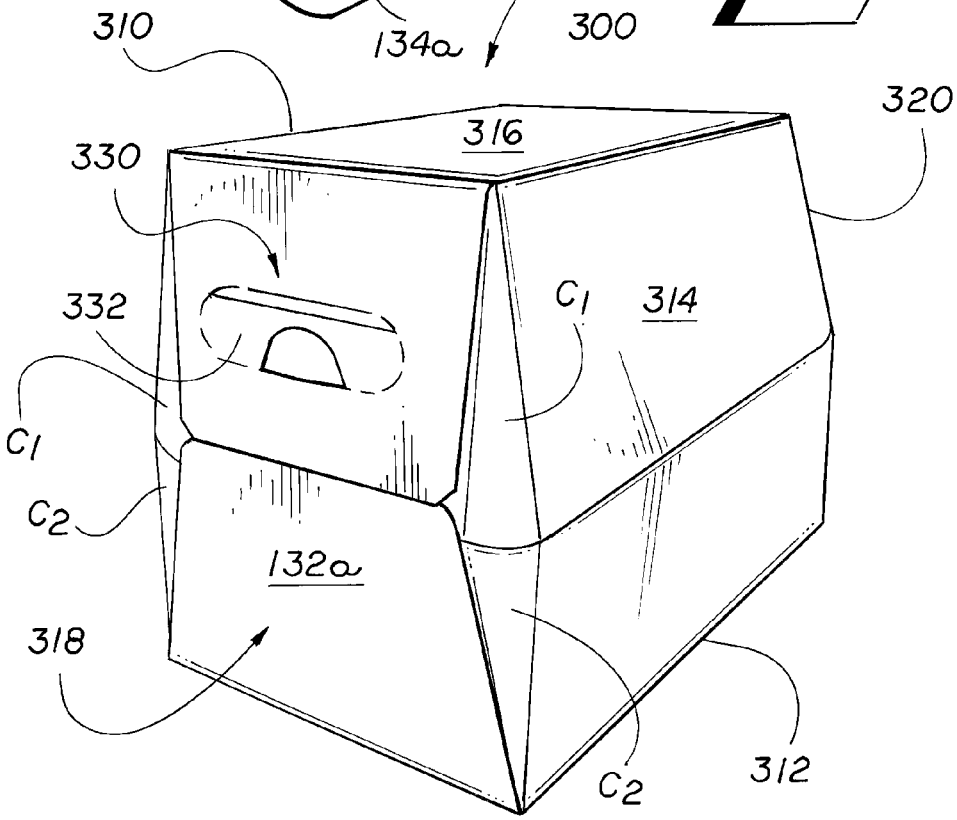

Continuing with FIGS. 1, 3, and 4, the end closure structures of the carton 300 are formed by folding the end flaps as described herein. First and second side end flaps 130*a*, 134*a* are folded inwardly toward the open end of the tubular structure along fold lines 140*a*, 144*a* and fold lines 160*a*, 164*a* such that upper portions are substantially coplanar with one another and lower portions are substantially coplanar with one another. The end flaps 130*a*, 134*a* are folded around adjacent articles. Glue is applied to glue locations G1, G2, G3 and top end flap 136*a* is folded along fold line 146*a* to overlap, and is thereby secured to, the upper portions of side end flaps 130*a*, 134*a*. Here, as illustrated in FIG. 5, main handle flap 186*a* is secured to minor handle flaps 180*a*, 184*a* such that severance line 206*a* aligns with the severance lines 200*a*, 204*a*, the fold line 196*a* aligns with the fold lines 190*a*, 194*a*, and the notch 216*a* aligns with the notches 210*a*, 214*a*. Continuing with FIGS. 1, 3, and 4, Glue is applied to glue locations G4, G5 and the bottom end flap 132*a* is folded along fold line 142*a* to overlap, and is thereby secured to, the lower portions of the side end flaps 130*a*, 134*a* and to the distal end of the top end flap 136*a*. Thereby, the end closure structures of the carton 300 are formed, as shown in FIG. 4, and the carton 300 is fully erected. The end closure structures define end walls 318, 320 of the carton 300.

Referring to FIGS. 4-8, each composite end wall 318, 320 includes a handle 330 with a handle flap 332. For clarity, the handle 330 and handle flap 332 of end wall 318 are described in further detail. The handle 330 includes the handle slots 170*a*, 174*a* and the main handle opening 176*a*. The handle flap 332 includes the minor handle flaps 180*a*, 184*a* and the main handle flap 186*a*. For purposes of clarity, although both minor handle flaps 180*a*, 184*a* are involved in the operation of the handle 330, only minor handle flap 180*a* is described in detail below.

Referring to FIGS. 5 and 6, to operate the handle 330, the user typically applies a force F to initiate a tear along aligned severance lines 200*a*, 206*a* so that the handle flap 332 can be folded into the carton 300 and the handle 330 can receive a user's hand. The force F to initiate a tear must be minimized since a user cannot apply a large force with the hand-motion that is typically used to initiate the tear. For example, the user presses fingertips against the handle flap 332 to initiate the tear. To initiate such a tear, the typical path of least resistance through the overlapping end flaps 136*a*, 130*a* is the aligned severance lines 206*a*, 200*a*.

However, where glue spreads from glue location G3 into the glue spreading area G3*s* so as to cover severance line 200*a*, a force F that would normally initiate a tear at the free ends of aligned severance lines 200*a*, 206*a* (adjacent notch 210*a*, 214*a*) is prevented from doing so. To facilitate initiating the tear, the relief severance line 220*a* defines a new path of least resistance that goes around the glue-blocked portion of severance line 200*a*. As such, the force F continues to initiate a tear.

Referring to FIG. 6, the new path of least resistance includes the severance line 206*a* through the thickness t1 of the top end flap 136*a*; the space between the main handle flap 186*a* and the minor handle flap 180*a* from the severance line 206*a* to the relief severance line 220*a*; the relief severance line 220*a* through part of the thickness t2 of the first side end flap 130*a*; a delamination plane between two layers L1, L2 (shown in FIG. 8) of the delamination section 230*a* of the minor handle flap 180*a* from the relief severance line 220*a* to the severance line 200*a*; and the severance line 200*a* through the remainder of the thickness t2 of the first side end flap 130*a*. The relief severance line 220*a* is configured to initiate delamination; since it only extends through part of the thickness of the side end flap 130*a*, it directs the new path of least resistance through the layers of the delamination section 230*a*.

Although glue in glue spreading area G3*s* may help secure the main handle flap 186*a* to the minor handle flap 180*a*, the force to separate main handle flap 186*a* and minor handle flap 180*a* is less than what is required to break severance line 200*a* when it is blocked by glue in glue spreading area G3*s*. Similarly, the force to cause delamination of at least delamination section 230*a* is less than what is required to break severance line 200*a* when it is blocked by glue in glue spreading area G3*s*.

Referring to FIGS. 5-8, when operating the handle 300 where glue is in glue spreading area G3*s* so as to cover the severance line 200*a*, force F is applied to the handle flap 332 in the same manner. Here, the force F separates the handle flap 332 from the end wall 318 along the new path of least resistance. To initiate a tear along the severance ones 200*a*, 206*a*, the force F breaks the severance line 206*a* to initially separate the main handle flap 186 from the end wall, separates the main handle flap 186*a* from the delamination section 230*a*, breaks the relief severance line 220*a*, delaminates a first layer L1 of at least the delamination section 230*a* from a second layer L2 of at least the delamination section 230*a*, and breaks part of severance line 200*a* to separate the second layer L2 and minor handle flap 180*a* from the end wall 318. The first layer L1 and part of the delamination section separates from the minor handle flap 180*a* and remains attached to the end wall 318 as shown in FIGS. 7 and 8. As such, the relief severance line 220*a* is configured to initiate delamination and the delamination of section 230*a* allows the tear initiation along aligned severance lines 200*a*, 206*a* for handle flap 332. The initiation of delamination of at least the delamination section 230*a* facilitates a complete tear along the severance line 200*a* at a point that is displaced from the distal end of the severance line 200*a*. For example, the point is where the relief severance line 220*a* intersects the severance line 200*a*.

It should be understood that the tear initiation feature is not limited to that of the illustrated handle. Such a feature is applicable to other detachable features defined by severance lines including dispensers or other structures that are detached to form an opening to dispense articles, other handle configurations, and other structures for forming openings in the carton.

The present invention has been illustrated in relation to particular embodiments that are intended in all respects to be illustrative rather than restrictive. For example, as used herein, directional references such as top, base, bottom, end, side, inside, outside, upper, middle, lower, front, and rear do not limit the respective walls of the carton to such orientation, but merely serve to distinguish these walls from one another. Any reference to hinged connection should not be construed as necessarily referring to a junction including a single hinge only; indeed, it is envisaged that hinged connection can be formed from one or more potentially disparate means for hingedly connecting materials.

The above-described embodiments are merely exemplary illustrations of implementations set forth for a clear understanding of the principles of the invention. Variations, modifications, and combinations may be made to the above-described embodiments without departing from the scope of the dams. All such variations, modifications, and combinations are included herein by the scope of this disclosure and the following claims.

I claim:

1. A carton, comprising:

a wall, comprising:

an overlapping portion where a first panel overlaps a second panel;

a handle, comprising:

a first handle flap defined in the first panel by a first severance line; and a second handle flap defined in the second panel by a second severance line, the first severance line being in substantial registry with the second severance line in the overlapping portion; the second handle flap comprising a relief severance line extending from the second severance line such that the relief severance line divides the second handle flap into a delamination section and the other section, the relief severance line being configured to initiate delamination of at least the delamination section.

2. The carton of claim 1, wherein the relief severance line comprises a half cut that penetrates through part of the thickness of the second handle flap.

3. The carton of claim 1, the second panel comprising glue locations that secure the first and second panels of the overlapping portion to one another, the relief severance line being formed on a side of an adjacent section of the second severance line that is opposite one of the glue locations.

4. The carton of claim 1, wherein the delamination section comprises an area of the second panel defined by the relief severance line and the second severance line.

5. The carton of claim 4, wherein the relief severance line is configured to initiate separation of a first layer of at least the delamination section from a second layer of at least the delamination section such that the first layer remains attached to the wall and the second layer remains attached to the second handle flap.

6. The carton of claim 1, wherein the initiation of delamination of the delamination section facilitates initiation of a tear along the registered first and second severance lines.

7. The carton of claim 6, wherein the initiation of delamination of at least the delamination section facilitates a complete tear along the second severance line at a point that is displaced from a distal end of the second severance line.

8. The carton of claim 7, wherein the point is a point where the relief severance line intersects the second severance line.

9. The carton of claim 1, wherein the relief severance line is substantially covered by the first panel.

10. The carton of claim 1, wherein the relief severance line extends all the way across the second handle flap to an edge of the second handle flap.

11. A blank, comprising:

a series of panels configured to form a tubular structure; and end flaps configured to form an end closure structure at an open end of the tubular structure, the end flaps comprising:

a first end flap and a second end flap, the first end flap configured to overlap the second end flap, the first end flap comprising a first handle flap defined by a first severance line, the second end flap comprising a second handle flap defined by a second severance line, the first severance line configured to be in substantial registry with the second severance line, the second handle flap comprising a relief severance line extending from the second severance line such that the relief severance line divides the second handle flap into a delamination section and the other section, the relief severance line being configured to initiate delamination of at least the delamination section of the second handle flap.

12. A carton, comprising:

a wall comprising overlapping portions of an outside panel and an inside panel, the outside panel comprising an outside handle flap defined by an outside severance line and the inside panel comprising an inside handle flap defined by an inside severance line, at least a portion of the outside severance line being in substantial registry with at least a portion of the inside severance line where the outside panel overlaps the inside panel, the inside handle flap comprising a relief severance line extending from the inside severance line such that the relief severance line divides the inside handle flap into a delamination section and the other section, the relief severance line is configured to initiate delamination of at least the delamination section of the inside handle flap; and a structure that is at least partially detachable from the carton along the outside and inside severance lines.

13. The carton of claim 12, wherein the relief severance line comprises a half-cut line that penetrates through part of the thickness of the inside handle flap.

14. The carton of claim 12, wherein the overlapping portion of the inside panel includes glue locations and the relief severance line is formed on a side of an adjacent section of the inside severance line that is opposite one of the glue locations.

15. The carton of claim 12, wherein the delamination section comprises an area of the inside panel defined by the relief severance line and the inside severance line.

16. The carton of claim 15, wherein the relief severance line is configured to initiate separation of a first layer of at least the delamination section from a second layer of at least the delamination section such that the first layer remains attached to the wall and the second layer remains attached to the structure.

17. The carton of claim 12, wherein the initiation of delamination of at least the delamination section facilitates initiation of a tear along the registered outside and inside severance lines.

18. The carton of claim 17, wherein the initiation of delamination of at least the delamination section facilitates a complete tear along the inside severance line at a point that is displaced from a distal end of the inside severance line.

19. The carton of claim 18, wherein the point is a point where the relief severance line intersects the inside severance line.

20. The carton of claim 12, wherein the relief severance line is substantially covered by the outside panel.

* * * * *